US005787540A

United States Patent [19]

Hirschmann

[11] Patent Number: 5,787,540

[45] Date of Patent: Aug. 4, 1998

[54] TOOTHBRUSH FOR CLEANING OF THE ARCH OF HUMAN TEETH

[76] Inventor: Jean E. Hirschmann, 1158 Landburn Cir., Westlake Village, Calif. 91362

[21] Appl. No.: 653,882

[22] Filed: May 28, 1996

[51] Int. Cl.[6] ..... A46B 9/04

[52] U.S. Cl. ..... 15/167.1; 15/172; 15/207.2

[58] Field of Search ..... 15/DIG. 5, 207.2, 15/167.1, 167.2, 172, 143.1, 144.1, 160, 159.1; D4/104, 105, 106, 111, 132

[56] References Cited

U.S. PATENT DOCUMENTS

| | | | |
|---|---|---|---|
| D. 96,599 | 8/1935 | Gilbert et al. | 15/167.1 |
| 1,500,722 | 7/1924 | Roush | 15/167.1 |
| 1,520,730 | 12/1924 | Street | 15/167.1 |
| 2,051,687 | 8/1936 | Dressler | 15/167.1 |
| 4,882,803 | 11/1989 | Rogers et al. | 15/DIG. 5 |
| 5,315,731 | 5/1994 | Millor | 15/DIG. 5 |

FOREIGN PATENT DOCUMENTS

| | | | |
|---|---|---|---|
| 704920 | 4/1941 | Germany | 15/167.1 |
| 4549 | 11/1909 | United Kingdom | 15/167.1 |

*Primary Examiner*—Gary K. Graham
*Attorney, Agent, or Firm*—Jack C. Munro

[57] ABSTRACT

A manually operable toothbrush which has been specifically designed in shape to facilitate cleaning of the mandibular lingual anterior surface of the arch of the lower teeth and the maxillary anterior palatal area of the arch of the upper teeth. The brush includes a rigid handle and a rigid head with the head being mounted at an angular relationship relative to the handle. The interior surface of the head has mounted thereon a series of bristles. These bristles are located in a curved pattern and also in a tapered form which facilitate access to the surfaces of the teeth upon which the toothbrush is to be used. The shape of the head and the angle of the head to the handle can be adjusted according to individual desires.

4 Claims, 2 Drawing Sheets

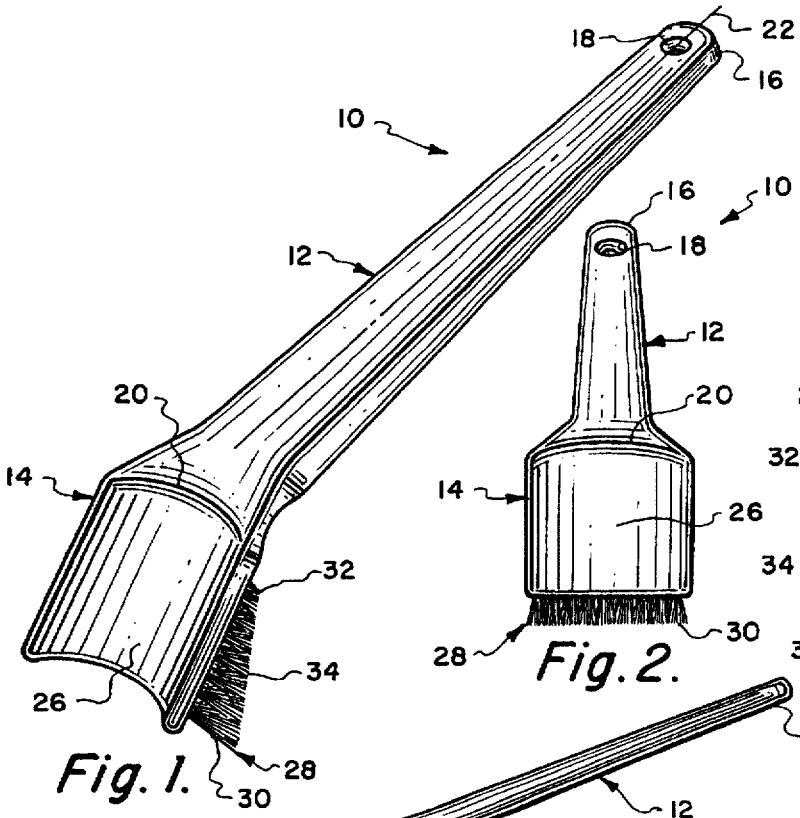
Fig. 1.
Fig. 2.
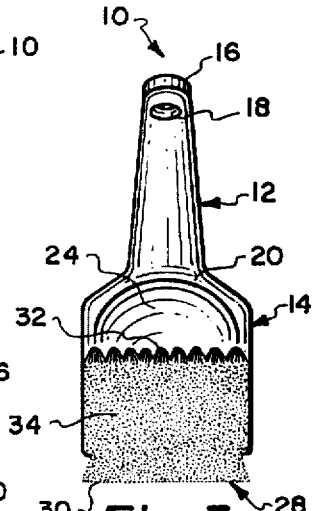
Fig. 3.
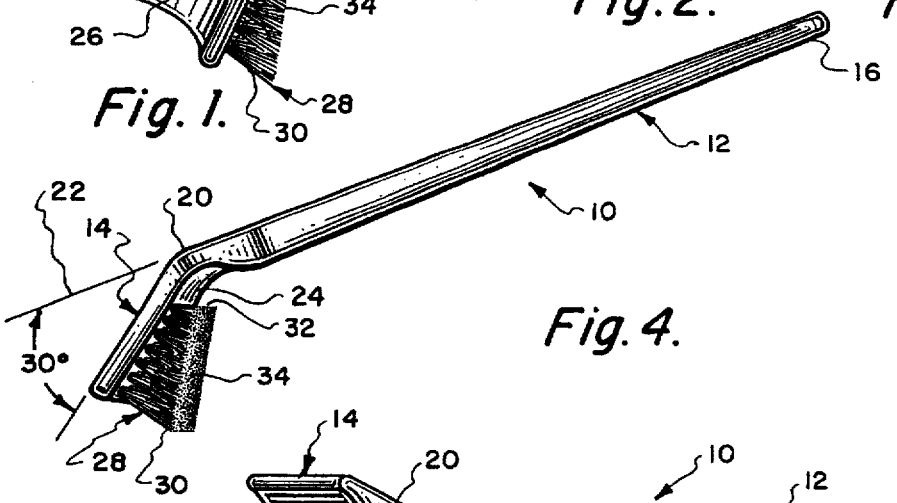
Fig. 4.
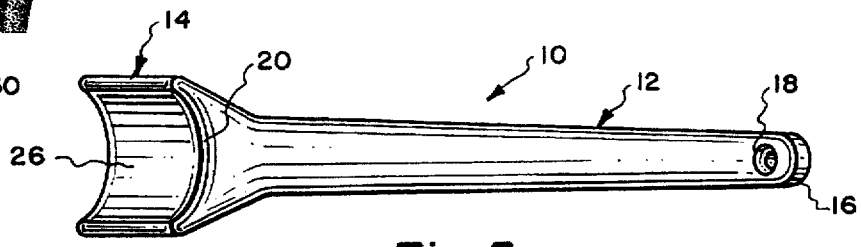
Fig. 5.
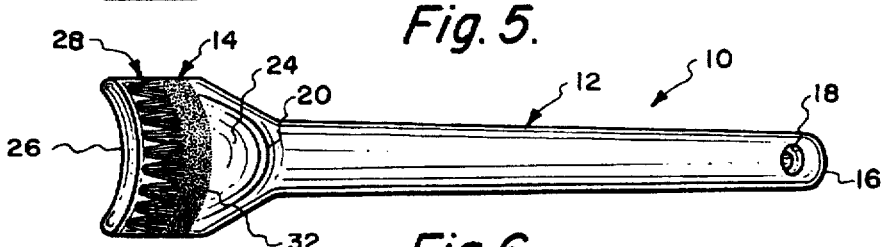
Fig. 6.

TOOTHBRUSH FOR CLEANING OF THE ARCH OF HUMAN TEETH

BACKGROUND OF THE INVENTION

1.) Field of the Invention

The field of this invention relates to toothbrushes and more particularly to a toothbrush that is designed to facilitate cleaning of certain "hard to reach" areas of human teeth.

2.) Description of Prior Art

Toothbrushes are in exceedingly common use by humans. For a great number of individuals a toothbrush is used at least twice a day generally once in the morning and once at night. Generally toothpaste is used with the toothbrush with the toothbrush placed within one's mouth and then moved in a reciprocating manner across the surfaces of the teeth in a manner to remove food particles, tartar and plaque from the teeth.

Most toothbrushes utilize a straight handle which is connected to a head area with the head area being in alignment with the handle. Mounted on the head is a bristle section with the bristle section being essentially in the shape of a block. Recently there have been some attempts at designing the bristle area in different shapes to facilitate the cleaning operation of the teeth. One known bristle area utilizes a plurality of rows of longer lengthed tufts and then a plurality of rows of shorter lengthed tufts. Another toothbrush locates the outer end of the tufts of the bristle area in a certain pattern such as being tapered. Although these improvements have some merit in cleaning of certain areas of the teeth, such as in the molar area and on the exterior area of the teeth, there has not been known a toothbrush that has been specifically designed for cleaning the anterior surfaces of the arch of the front teeth, both upper and lower. It is difficult to utilize a conventional toothbrush in the narrow anterior portion of the arch because the brush head generally is too large to be placed horizontally to effect proper cleaning.

SUMMARY OF THE INVENTION

A manually operable toothbrush which is composed of an elongated handle and a head with the head being mounted on the handle at an inclined angle relative to the handle. The angle of the head to the handle can be adjusted in a second embodiment of this invention to have the toothbrush accommodate to an individuals preference. Across the head there is formed a bow with this bow being concave on the exterior surface of the head. The amount of bow is to be adjustable in the second embodiment of this invention to adjust the bow to the precise shape of the users arch of the front teeth. Fixedly mounted on the interior surface of the head is a bristle section with the outer surface of the bristles being in the shape of a segment of the sidewall of a cylinder. The bristles are tapered with the tufts of the bristles being longer in length at the free outer edge of the head with the tufts of the bristles being shortest in length directly adjacent the portion of the head that is nearest the handle.

The primary objective of the present invention is to construct a toothbrush which facilitates the cleaning of the mandibular lingual anterior surface of the arch of one's teeth.

Another objective of the present invention is to construct a toothbrush which facilitates cleaning of the maxillary anterior palatal area of the arch of one's teeth.

Another objective of the present invention is to construct a toothbrush which facilitates removal of plaque in hard to reach areas of one's teeth.

Another objective of the present invention is to construct a toothbrush which helps to eliminate tartar buildup, gingivitis and periodontal disease.

BRIEF DESCRIPTION OF THE DRAWINGS

FIG. 1 is an isometric view of the first embodiment of toothbrush of the present invention;

FIG. 2 is a front view of the first embodiment of toothbrush of the present invention;

FIG. 3 is a rear view of the first embodiment of toothbrush of the present invention;

FIG. 4 is a left side view of the first embodiment of toothbrush of the present invention;

FIG. 5 is a top plan view of the first embodiment of toothbrush of the present invention;

FIG. 6 is a bottom plan view of the first embodiment of toothbrush of the present invention;

DETAILED DESCRIPTION OF THE PREFERRED EMBODIMENT

Figure 7:
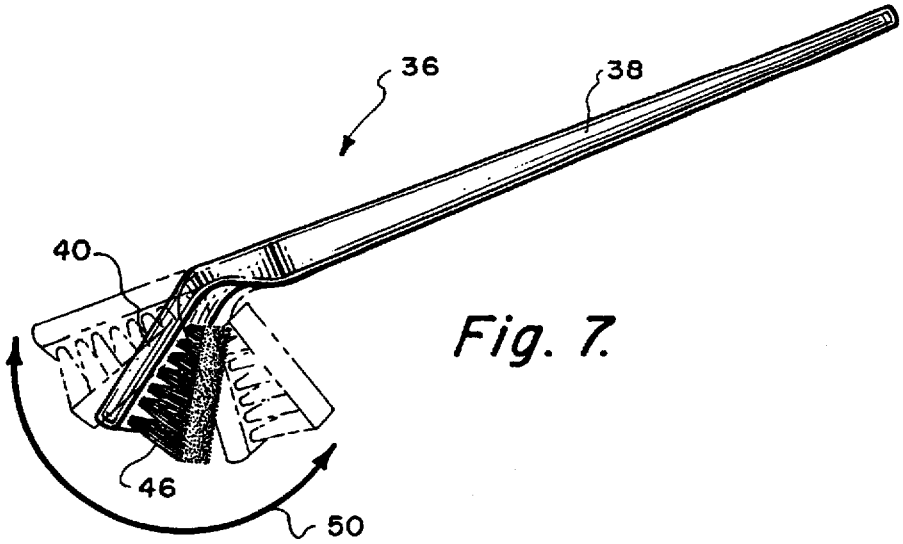
FIG. 7 is a left side view of the second embodiment of the toothbrush of the present invention where the head of the toothbrush is to be adjustable and its angular relationship relative to the handle.

Referring particularly to the drawing, there is shown the first embodiment of toothbrush 10 of this invention which is constructed generally of a handle 12 and a head 14. Both the handle 12 and the head 14 are intended to be constructed of a rigid material with generally a plastic being preferred. A typical plastic would be a polyethylene plastic. The handle 12 is elongated and has an outer end 16 within which is located a hole 18. The hole 18 is to be utilized to facilitate hanging of the toothbrush 10 when not in use. Typical hanging would be on a protrusion such as a nail-like object. The handle 12 is connected to the head 14 at a shank 20. The shank 20 is bent such that the head 14 is located at an inclined angle relative to the handle 12. The handle 12 includes a longitudinal center axis 22 and the head 14 is to be located at approximately a thirty degree angle relative to that axis 22. This means that the interior surface 24 of the head 14 forms in essence about a 150 degree angle relative to the handle 12.

The head 14 is formed of a bowed (arcuate) configuration. This bowing produces a concavity 26 formed within the exterior surface of the head 14. The longitudinal dimension of the concavity 26 is located parallel to the longitudinal axis 22. This bowing of the head 14 is across the head 14, rather than longitudinally along the length of the head 14. It is the purpose of the bow to produce a shape that will essentially duplicate the anterior surface of the arch of the front upper and lower teeth of a human. Typically the bow will have a radius of about one inch.

Mounted on the interior surface 24 is a bristle section 28. The bristle section is composed of a plurality of tufts with the tufts at the outer free edge 30 being of a length of two to three times greater than the length of the tufts at the inner edge 32 which is located directly adjacent the shank 20. This variation in the lengths of the tufts of the bristle section 28 produces a tapered section 34 which comprises the brushing plane of the bristle section 28. This tapered section 34 is smoothly contoured and actually will be in the shape of a portion of the sidewall of a cylinder. The reason for this shape is that the outer surface of the bristle section 28 is parallel to the curvature of the concavity 26.

The toothbrush 10 is to be grasped by the handle 12 with the user to locate the head 14 within the mouth with the surface 34 to be positioned directly against either the mandibular lingual anterior surface of the arch of the lower teeth or the maxillary anterior palatal surface of the arch of the upper teeth and moved in a vertical brushing motion. The user then is to use the toothbrush 10 in a reciprocating manner in order to facilitate cleaning of these particular areas of the teeth. It is to be understood that the toothbrush 10 is really not intended to be used to clean the entire teeth of one's mouth, but only these specific areas.

Referring particularly to FIG. 7–10 of the drawings, there is shown the second embodiment 36 of toothbrush of this invention. The second embodiment 36 includes an elongated handle 38 to which is attached head 40. Head 40 includes a concavity 42 which produces the bow in the head 40. The handle 38 and the head 40 are generally to be constructed of plastic material. Embedded within the plastic material of both the handle 38 and the head 40 is a section 44 of metallic sheet material. By the application of the small manual force between the handle 38 and the head 40, the head 40 can be moved to different angular inclinations relative to the handle 38. This bending of the head 40 to different angles of inclination is shown in phantom lines in FIG. 7 with the bending of the head being depicted generally in the direction of arrow 50. Typical material for the section 44 could be aluminum or possibly even a leaded steel composition.

Figure 8:
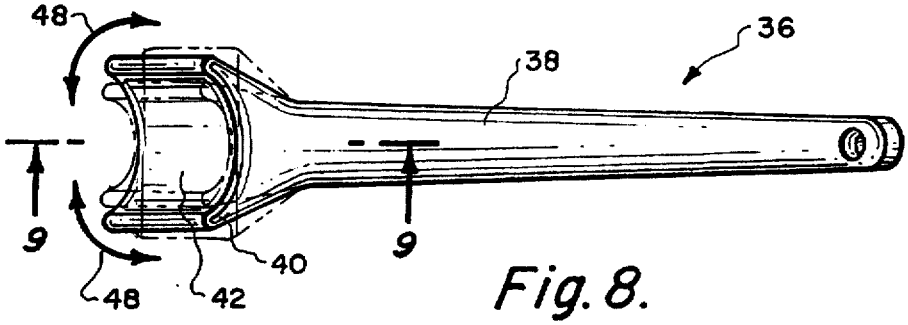
FIG. 8 is a top plan view of the second embodiment of the toothbrush of the present invention showing that the bow located in the head of the toothbrush is also adjustable.
Figure 9:
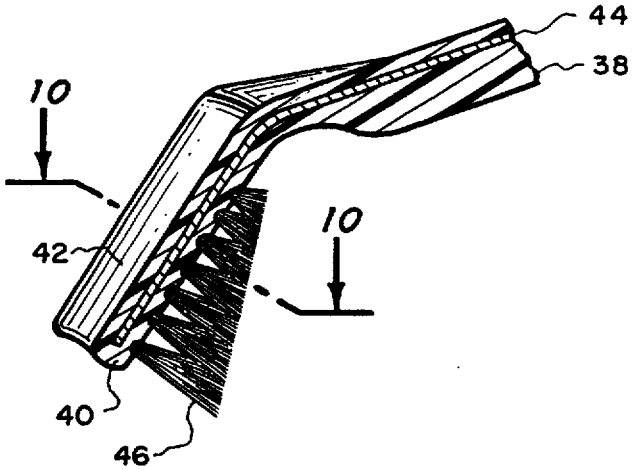
FIG. 9 is a cross-sectional view through the head portion of the second embodiment of the toothbrush of the present invention taken along line 9—9 of FIG. 8.
Figure 10:
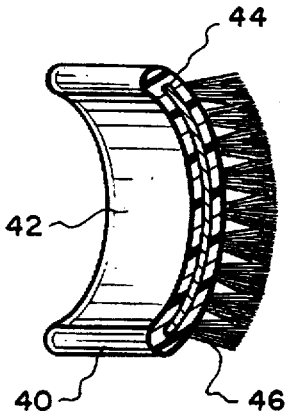
FIG. 10 is a transverse cross-sectional view taken through the head portion of the second embodiment of the toothbrush of the present invention taken along line 10—10 of FIG. 9.

The bow of the head 40 is also to be adjustable as is depicted generally by the arrows 48 in FIG. 8. The concavity 42 could be bent to assume a more flatten configuration or it could be bent to assume a more equally concave configuration. This adjusting of the head 40 as to the sharpness or shallowness of the concavity 42 is so that the individual user can position the head 40 and substantially the identical configuration of the arch of the front teeth of the user. Some people have a more shallow arch than others, while other people have a pronounced pointed type of arch.

Also, the adjusting of the inclination of the head 40 relative to the handle 38 is again to accommodate to these specific desires. A certain user may want the head 40 to be at around 35 degrees relative to the handle 38 while yet another user may want the head 40 to be located at approximately 25 degrees relative to the handle 38.

The bristle head 46 is mounted on the head 40 and is essentially identical to the bristle head 28 previously discussed.

What is claimed is:

1. A toothbrush comprising:

an elongated handle having a first longitudinal center axis;

a head attached to one end of said elongated handle, said head being elongated, said head being constructed of sheet material, said head having a second longitudinal center axis, said second longitudinal center axis intersecting and being located at an inclined angle relative to said first longitudinal center axis, said head having an exterior surface and an interior surface, said interior surface forming an obtuse interior angle with said first axis, said head having an outer free edge;

a bristle section formed of a plurality of tufts attached to said interior surface of said head, said bristle section extending from said outer free edge to directly adjacent said elongated handle, said bristle section extending substantially totally across said head terminating in free outer ends, said bristle section having a brushing plane defined by the free outer ends of said bristle section, said brushing plane being in a shape of a segment of a sidewall of a cylinder, said bristle section being tapered resulting in said tufts being longer in length at said outer free edge, whereby said toothbrush can be used effectively to clean the mandibular lingual anterior surface of the arch of the lower teeth and the maxillary anterior palatal surface of the arch of the upper teeth of a human; and said head being bowed forming a concavity in said exterior surface, said concavity extending transversely across said head with said concavity having a third longitudinal center axis, said third longitudinal center axis coplanar with said second longitudinal center axis, said second longitudinal center axis coplanar with said first longitudinal center axis.

2. The toothbrush as defined in claim 1 wherein:

said obtuse angle being approximately 150 degrees.

3. The toothbrush as defined in claim 1 wherein:

said head being adjustable relative to said elongated handle in order to locate said head at various said inclined angles relative to said elongated handle to thereby provide individual adjustability according to the physical requirements of the user.

4. The toothbrush as defined in claim 3 wherein:

said concavity being adjustable so as to make said concavity more of a shallow configuration or more of a deeply concave configuration.

* * * * *